US005813425A

United States Patent [19]

Carter

[11] Patent Number: 5,813,425

[45] **Date of Patent: *Sep. 29, 1998**

[54] COLLAPSIBLE SHELTER WITH ELEVATED CANOPY

[76] Inventor: Mark C. Carter, 10131 Kernwood Ct., Alta Loma, Calif. 91737

[ * ] Notice: The term of this patent shall not extend beyond the expiration date of Pat. No. 5,632,292.

[21] Appl. No.: 823,589

[22] Filed: Mar. 25, 1997

Related U.S. Application Data

[63] Continuation of Ser. No. 552,091, Nov. 2, 1995, Pat. No. 5,632,292, and a continuation-in-part of Ser. No. 42,996, Apr. 5, 1993, Pat. No. 5,490,533.

[51] Int. Cl.[6] ..... E04H 15/50

[52] U.S. Cl. ..... 135/145; 135/151; 135/159

[58] Field of Search ..... 135/130, 131, 135/143, 144, 145, 146

[56] References Cited

U.S. PATENT DOCUMENTS 5,634,483 6/1997 Gwin ..... 135/124 X

*Primary Examiner*—Lanna Mai

*Attorney, Agent, or Firm*—Fulwider Patton Lee & Utecht, LLP

[57] ABSTRACT

The collapsible shelter includes a truss framework that provides an elevated, raised canopy that can be gabled or have a high peak in a raised, extended configuration. The canopy is supported by at least three legs, and outer perimeter and central truss pairs of link members pivotally connected in scissors configurations. The link members of the perimeter truss pairs are pivotally connected together in a scissors configuration so as to be extendable from a first collapsed position extending horizontally between adjacent legs to a second extended position extending above the legs, to elevate the canopy in a gabled or high peaked configuration. In a preferred embodiment, tensioning cables may also be secured between the legs and a central support connected to the central truss pairs, to provide additional strength and stability to the framework of the shelter in a raised, extended configuration.

7 Claims, 11 Drawing Sheets

FIG. 3
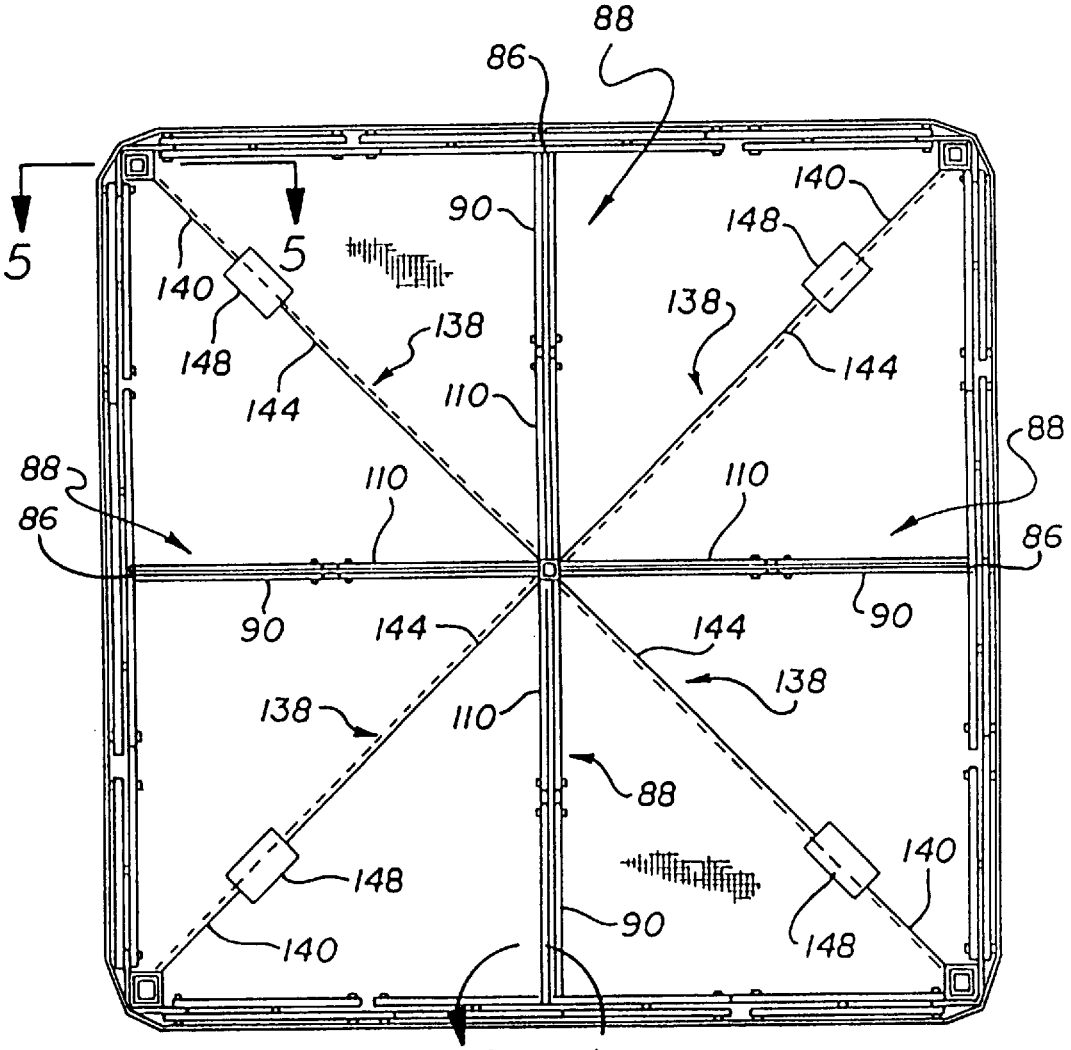
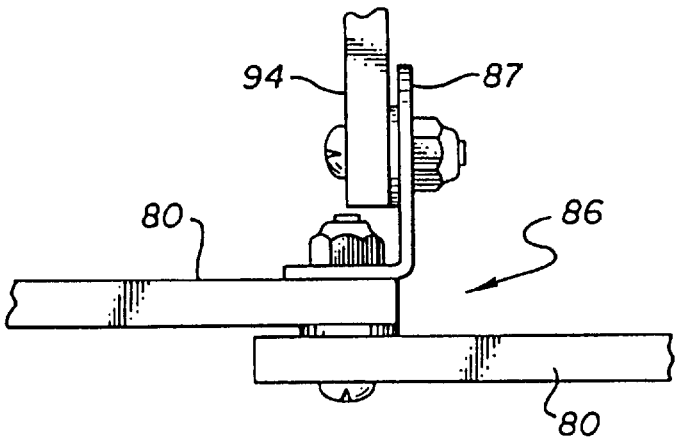
FIG. 4

COLLAPSIBLE SHELTER WITH ELEVATED CANOPY

RELATED APPLICATIONS

This is a continuation, of application Ser. No. 08/552,091, filed Nov. 2, 1995; now U.S. Pat. No. 5,632,292; which is a continuation-in-part of Ser. No. 08/042,996; filed Apr. 5, 1993, now U.S. Pat. No. 5,490,533.

BACKGROUND OF THE INVENTION

1. Field of the Invention

This invention relates generally to folding, collapsible structures, and more particularly relates to a collapsible, field shelter structure having an elevated canopy.

2. Description of Related Art

Temporary shelters that can be easily transported and rapidly set up at emergency sites can be particularly useful in providing temporary care and housing. Such shelters can also be useful for non-emergency outdoor gatherings, such as for temporary military posts, field trips, and the like. One such quickly erectable, collapsible shelter having a framework of X-shaped linkages, telescoping legs, and a canopy covering the framework is described in my U.S. Pat. No. 4,607,656. The legs of that shelter are capable of telescoping to about two or three times their stowed length, and the framework of X-shaped truss pairs is capable of horizontal extension between the legs to support a canopy. The framework can be constructed of lightweight material, and the telescoping legs can be extended to raise the framework of the shelter. However, the height of the canopy is limited to the extended length of the legs, and the canopy is essentially flat, allowing for collection of precipitation and debris on top of the canopy, which can promote leaks and tears in the canopy. In addition, the size and stability of the shelter is generally limited by the strength of the framework.

It would be desirable to provide an improved collapsible shelter with a support framework for the canopy that rises above the supporting legs, to provide for more headroom within the structure, and to allow for a reduction in the size and weight of the legs and framework required to achieve an adequate height of the canopy. It would also be desirable to provide a canopy structure that is gabled to shed precipitation and debris from the top of the shelter. It would be further desirable to provide a shelter framework that would provide greater strength and stability, to allow support of larger, lighter collapsible shelter structures. The present invention fulfills these needs.

SUMMARY OF THE INVENTION

Briefly, and in general terms, the present invention provides for a collapsible shelter with an improved truss framework that raises a gabled shelter canopy to provide increased headroom, strength and stability.

The invention accordingly provides for a collapsible shelter having a canopy with at least three vertically disposed legs supporting the canopy. At least two perimeter truss means are connected to each of the legs. Each of the perimeter truss means preferably includes at least one pair of first and second link members, with the first link member having an outer end connected to the upper end of one leg, and the second link member having an outer end slidably connected to the leg. The first and second link members are pivotally connected together in a scissors configuration so as to be extendable from a first collapsed position extending horizontally between two legs to a second extended position extending above the legs.

In one preferred embodiment, the perimeter truss means includes two essentially identical X-shaped perimeter truss pairs of first and second link members connected together by a central pivot. The two perimeter truss pairs of link members are connected together at their inner ends, and are connected on each side of the collapsible shelter between two adjacent legs. In this embodiment, the collapsible shelter can have three, four, or more sides.

At least two central truss means are also provided, with each of the central truss means including at least one pair of first and second link members connected together in a scissors configuration. Each of the central truss pairs are connected to the inner ends of one perimeter truss means, and the first and second link members are pivotally connected together in a scissors configuration so as to be extendable from a first collapsed position to a second extended position. In a preferred aspect of the invention, tensioning means are also secured between the leg slider member and the central support slider member, to provide additional strength and stability to the framework of the shelter in a raised, extended configuration.

In a preferred four-sided shelter embodiment, two first perimeter truss pairs of link members are connected to each of four legs. For each leg, the outer end of the first link of each truss pair connected to the leg is pivotally connected to the upper end of a leg, and the outer end of the second link is slidably connected to the leg, preferably being pivotally secured to a slider member on the leg. At least two first central truss pairs of link members are also provided, pivotally connected together in a scissors configuration, with each connected to the inner ends of one of the perimeter truss pairs. The outer ends of the central truss pairs are preferably pivotally connected to a junction of the inner ends of the perimeter truss pairs. Each of the central truss pairs preferably includes a first link having an outer end connected to an inner end of at least one of the first links of a perimeter truss pair on a side, an inner end, and a pivot point located at the longitudinal center point of the central truss pair first link. Each of the central truss pairs also preferably includes a second link having an outer end connected to an inner end of at least one of the second links of the perimeter truss pairs on a side, an inner end, and a pivot point located at the longitudinal center point of the central truss pair second link. The second links of the central truss pairs are preferably longer than the first links of the central truss pairs, so that in an expanded configuration of the shelter, the second link extends above the top of the legs. The inner ends of the first or second links of the central truss pairs are further preferably connected to at least one vertically oriented central support member, provided to support the canopy and give the canopy a high pitch, high peaked shape when the shelter framework is in an extended configuration. Tensioning means are also preferably provided between the leg slider member and the central support slider member.

In another embodiment, a three-sided shelter comprises a perimeter framework including two perimeter truss pairs of link members connected to each of the legs with each of the perimeter truss pairs including a first link member pivotally connected to an upper end of a leg, and a second link having an outer end pivotally connected to a leg slider member, slidably connecting the second link to the upper section of the leg. The inner ends of each perimeter truss pair are preferably pivotally connected to the inner ends of another perimeter truss pair at a junction centered between two legs of one side of the shelter framework. Three central truss pairs of link members are also provided, with each of the truss pairs being pivotally connected to the inner ends of at least one of the perimeter truss pairs at the junction. Each of the central truss pairs of link members preferably includes a first link having an outer end connected to the inner end of at least one of the first links of the perimeter truss pairs on a side. Each of the central truss pairs also preferably includes a second link having an outer end connected to the inner end of at least one of the second links of the perimeter truss pairs on a side. The second links of the central truss pairs are preferably longer than the first links of the central truss pairs, so that in an expanded configuration of the shelter, the second link extends above the top of the legs. The inner ends of the first or second links of the central truss pairs are further preferably connected to at least one vertically oriented central support member, provided to support the canopy and give the canopy a high pitch, high peaked shape when the shelter framework is in an extended configuration.

These and other aspects and advantages of the invention will become apparent from the following detailed description, and the accompanying drawing, which illustrates by way of example the features of the invention.

BRIEF DESCRIPTION OF THE DRAWINGS

FIG. 3 is a top sectional view of the collapsible shelter of the invention;

FIG. 4 is an enlarged view of a portion of the linkage between the perimeter truss pairs and the central truss pairs;

DETAILED DESCRIPTION OF THE PREFERRED EMBODIMENTS

The size and available headroom of previous collapsible shelters have been generally limited by the extended length of the legs of the structure, and provided essentially flat roof structures, allowing for collection of precipitation in pockets or puddles on top of the shelter. The collapsible shelter of the invention provides for larger, lighter collapsible shelter structures, with a raised gabled roof structure which also improves the strength and stability of the shelter.

Figure 1:
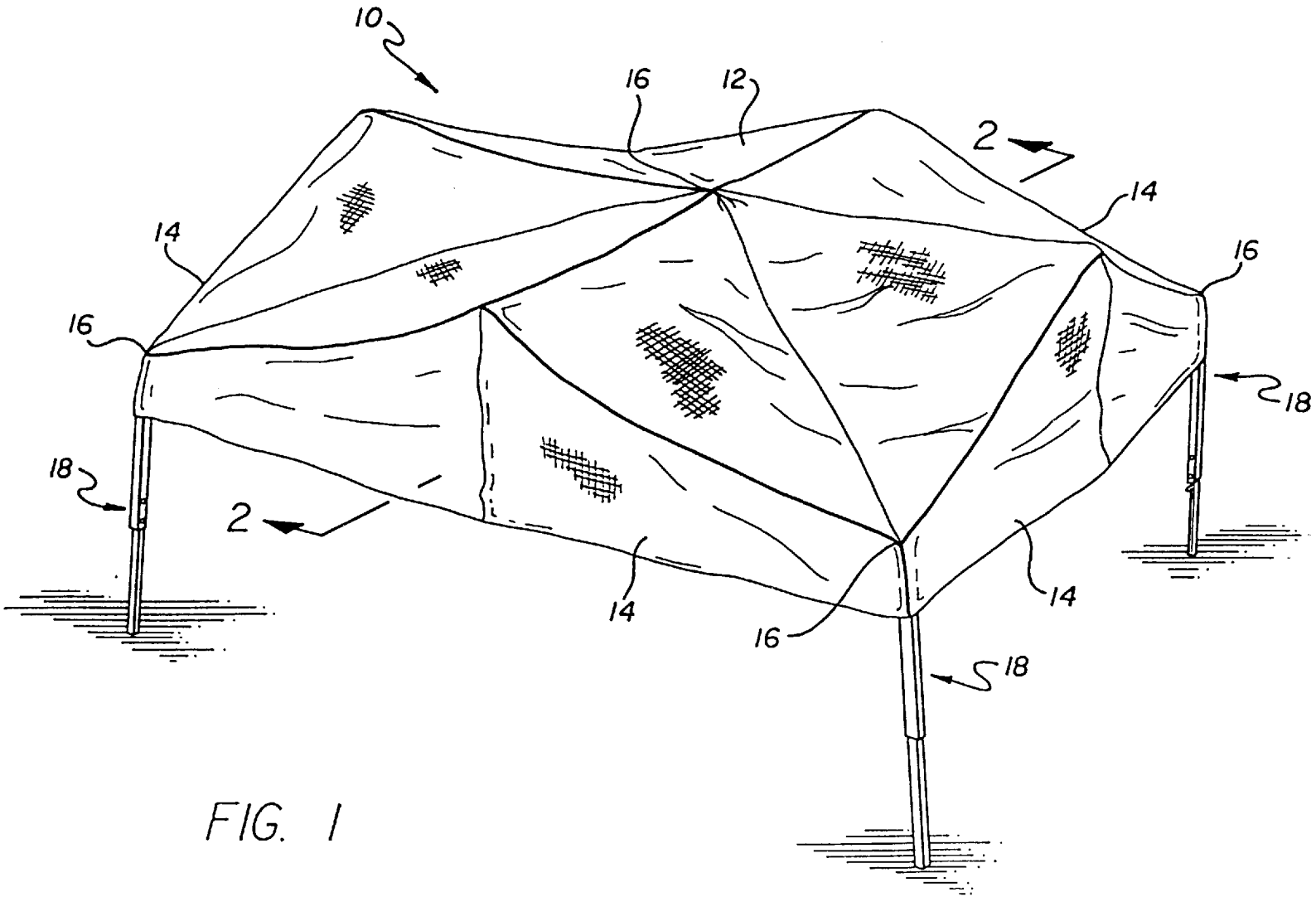
FIG. 1 is a perspective view of the collapsible shelter with an elevated canopy of the invention, showing the elevated gabled roof structure.

As is illustrated in the drawings, and particularly referring to a first preferred four-sided embodiment shown in FIG. 1, the invention is embodied in a collapsible shelter 10, having a canopy 12 with at least three sides 14, and preferably four sides, at least three corners 16, and preferably four corners. The canopy is preferably formed of nylon fabric, so as to be light and easily transportable, although the canopy could also be made of other suitable sheet materials, such as canvass, or other types of cloth fabric, or plastic. At least three, and preferably four, legs 18 supporting the canopy, with a leg disposed under each corner of the canopy. Particularly referring to FIGS. 2 and 5, each of the legs has an upper end 20 and a lower end 22, and preferably each leg includes telescoping upper and lower sections 24 and 26, respectively, with the telescoping lower section including a spring loaded detent pin 27 for indexing in apertures 28 provided in the upper section for adjusting the leg height as desired. The extendable lower section also preferably includes a foot portion 29 for engagement with the ground or other floor surface.

Figure 2:
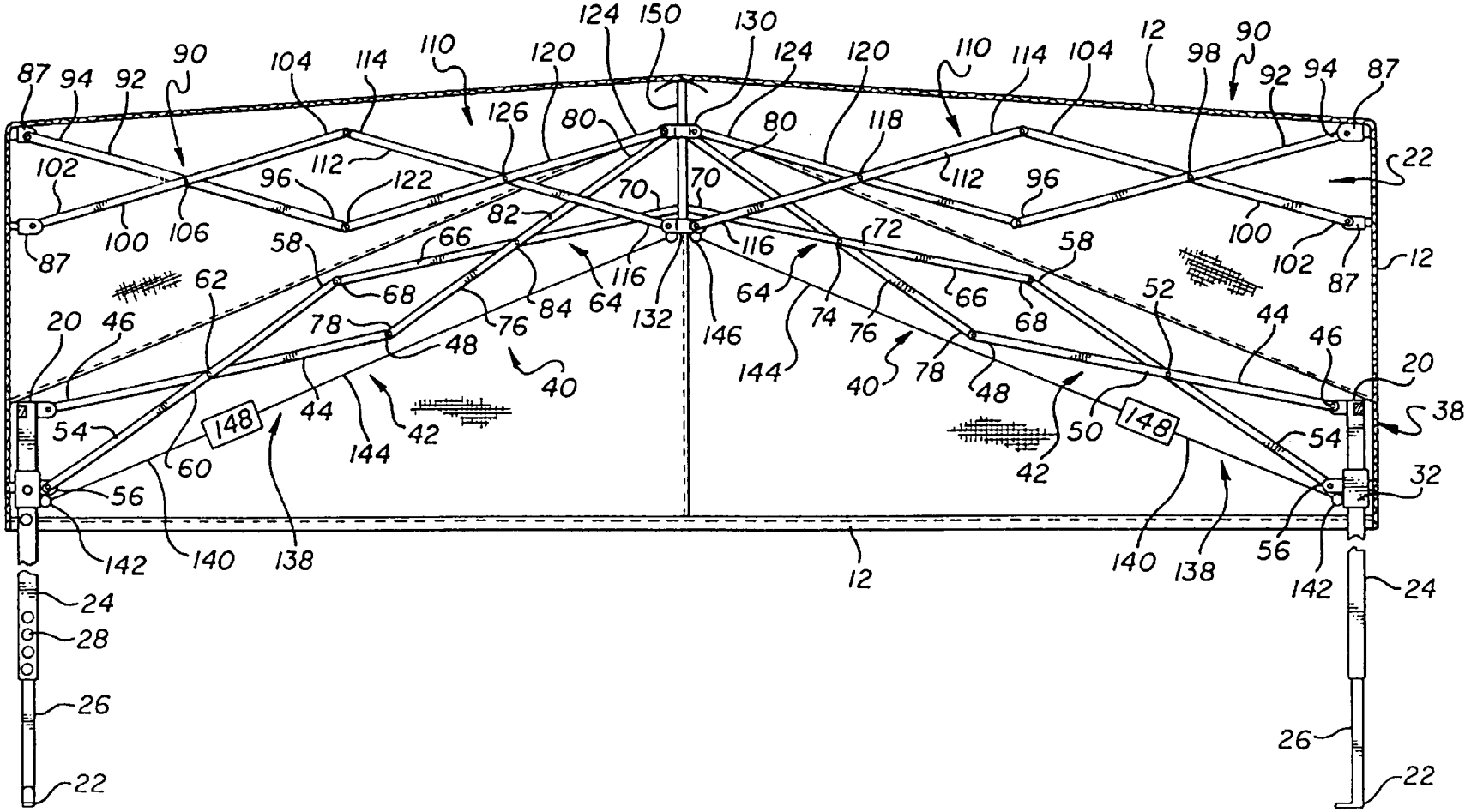
FIG. 2 is a cross-sectional elevational view of the collapsible shelter of the invention, taken along line 2—2 of FIG. 1, showing the perimeter and central truss pairs of the shelter in an extended, raised configuration.
Figure 5:
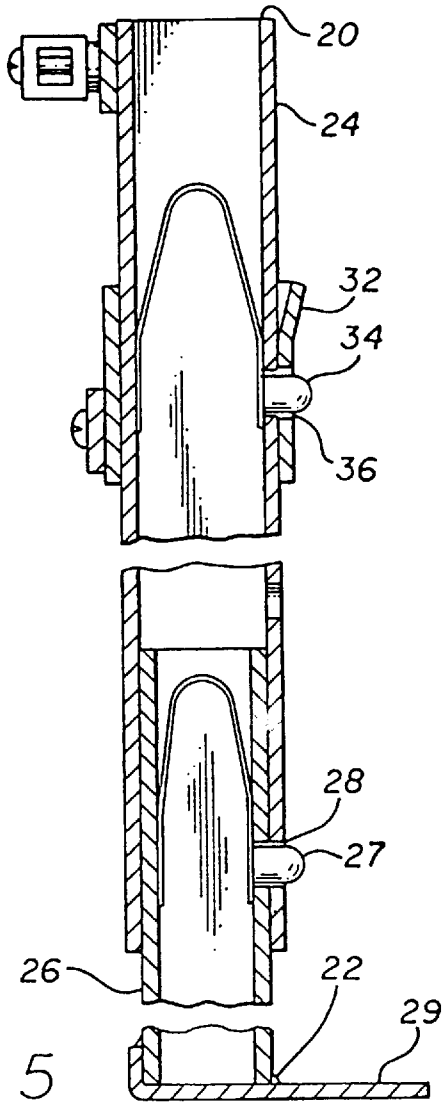
FIG. 5 is an enlarged sectional view of a leg of the collapsible shelter, taken along line 5—5 of FIG. 3.

As is best seen in FIG. 2, a leg slider member 32 is also slidably mounted on the upper section of each of the legs. With reference to FIG. 5, a spring loaded detent pin 34 is also provided in the upper leg section for indexing with an aperture 36 in the leg slider member, as will be further explained below.

Figure 6:
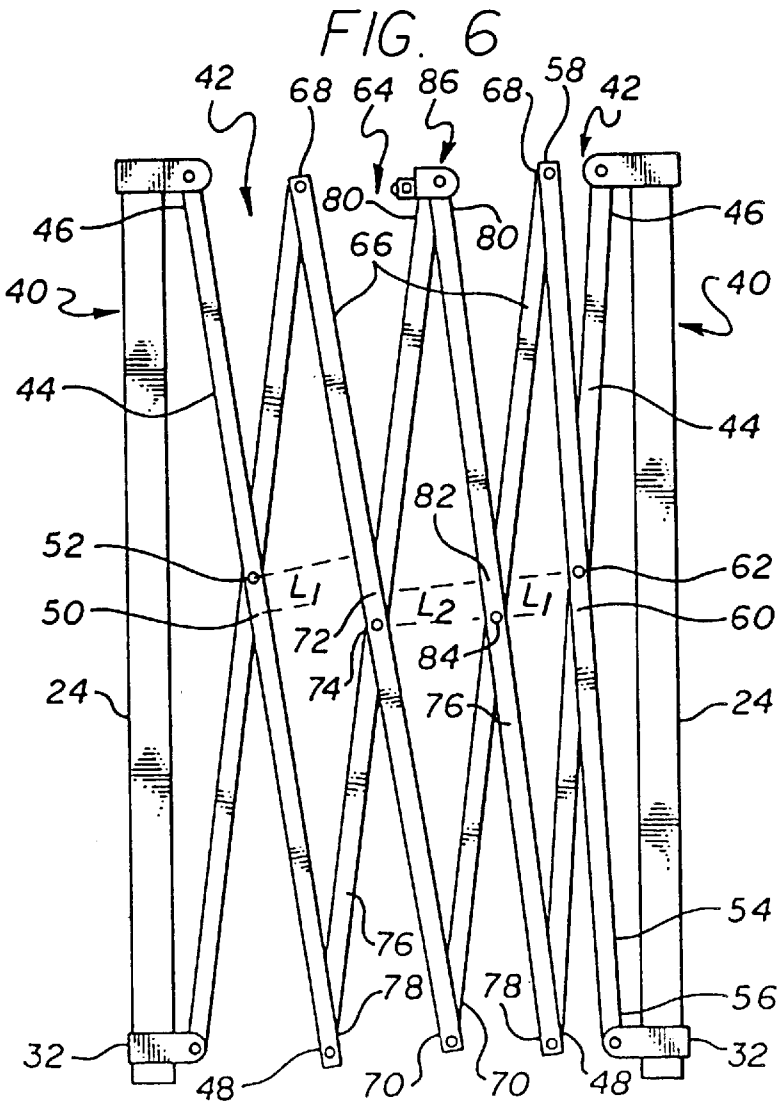
FIG. 6 is a side elevational view of the framework of the collapsible shelter, showing the perimeter truss pairs in a substantially collapsed configuration.

Referring to FIGS. 2 and 6, in the preferred four sided embodiment, the perimeter framework 38 includes perimeter truss means 40 including two first perimeter truss pairs 42 of link members connected to each of the legs at right angles, with each of the first perimeter truss pairs including a first link member 44 having an outer end 46 connected to the upper end of a leg, an inner end 48, a longitudinal center 50, and a pivot point 52 spaced apart from the longitudinal center toward the outer end by a predetermined distance $L_1$. Each of the first perimeter truss pairs further includes a second link 54 having an outer end 56 pivotally connected to the leg slider member, thus slidably connecting the second link to the upper section of the leg. The second link of the first perimeter truss pairs includes an inner end 58, a longitudinal center 60, and a pivot point 62 spaced apart from the longitudinal center toward the inner end by the same predetermined distance $L_1$. The pivot points of the first and second links in each of the first perimeter truss pairs are pivotally connected in a modified scissors configuration, so that although the first and second link members extend a short distance generally horizontally toward another leg in a first collapsed position of the shelter, as shown in FIG. 6, the first and second link members extend to a second extended position with the inner ends of the link members extending above the upper end of the leg, as shown in FIG. 2.

In a preferred embodiment, the perimeter truss means also includes a second perimeter truss pair 64 of link members, which is pivotally connected to each of the first perimeter truss pairs, to extend the framework further above the legs of the shelter. Each of the second perimeter truss pairs preferably includes a first link 66 having an outer end 68 pivotally connected to the inner end of the second link of the associated first perimeter truss pair, an inner end 70, a longitudinal center point 72, and a pivot point 74 spaced apart from the longitudinal center point toward the inner end a predetermined distance $L_2$. Each of the second perimeter truss pairs also preferably includes a second link 76 having an outer end 78 pivotally connected to the inner end of the first link of the associated first perimeter truss pair, an inner end 80, a longitudinal center point 82, and a pivot point 84 spaced apart from the longitudinal center point toward the outer end the predetermined distance $L_2$. The pivot points of the first and second links in each of the second perimeter truss pairs are preferably pivotally connected together, resulting in a modified scissors configuration so that the second truss pairs are also extendable from a first collapsed position extending generally horizontally between legs, to a second extended position extending above the first perimeter truss pair. The inner ends 70 and 80 of each second perimeter truss pair are further preferably pivotally connected to the inner ends 70 and 80 of another second perimeter truss pair at a junction 86 centered between two legs of one side of the shelter framework.

As is best seen in FIGS. 2, 3 and 4, a plurality of central truss means 88 are also provided, including at least two outer central truss pairs 90 of link members, with each of the outer central truss pairs being pivotally connected to the inner ends of at least one of the second perimeter truss pairs at the junction 86, such as by right angle bracket members 87, to which the inner ends of the second perimeter truss pairs and the outer central truss pairs are pivotally connected. In a preferred embodiment, the framework of the shelter has a square configuration, and four outer central truss pairs are provided, connected to the four side junctions of the shelter framework. Where the shelter framework has three sides, three outer central truss pairs may be provided. Each of the outer central truss pairs preferably includes a first link 92 having an outer end 94 connected to the inner end of the second link of the second perimeter truss pair, an inner end 96, and a pivot point 98 located at the longitudinal center point of the outer central truss pair first link. Each of the outer central truss pairs also preferably includes a second link 100 having an outer end 102 connected to the inner end of the first link of the second perimeter truss pair, an inner end 104, and a pivot point 106 located at the longitudinal center point of the outer central truss pair second link. Each of the pivot points of the first and second links of the outer central truss pairs are pivotally connected together to extend horizontally between the sides of the shelter framework.

In a preferred embodiment, the central truss means also includes at least two inner central truss pairs 110 of link members, with each of the inner central truss pairs being pivotally connected to the inner ends of an associated outer center truss pair. Each of the inner central truss pairs preferably includes a first link 112 having an outer end 114 connected to the inner end of the second link of the outer central truss pair, an inner end 116, and a pivot point 118 located at the longitudinal center point of the inner central truss pair first link. Each of the inner central truss pairs also preferably includes a second link 120 having an outer end 122 connected to the inner end of the first link of the outer central truss pair, an inner end 124, and a pivot point 126 located at the longitudinal center point of the inner central truss pair second link. Each of the pivot points of the first and second links of the inner central truss pairs are pivotally connected together to extend horizontally between the sides of the shelter framework. The inner ends of each of the first and second links of the inner central truss pairs are preferably pivotally connected to the inner ends of the first and second links of at least one other of the inner central truss pairs. The inner ends of the inner central truss pairs are preferably connected to at least one vertically oriented central support member 130 provided to support the canopy when the shelter framework is in an extended configuration. In a preferred embodiment, a central slider member 132 is pivotally connected to an inner end of the inner central truss pair, and is disposed to slidably engage the central support member when the shelter framework is in an extended configuration. The inner ends of each of the first links of the inner central truss pairs are preferably pivotally connected to one of the central support member and the central slider member, and the inner ends of each of the second links of the inner central truss pairs are preferably pivotally connected to the other of the central support member and the central slider member.

In the first preferred four-sided shelter embodiment illustrated in FIGS. 2 and 3, a tensioning means 138 is preferably connected between the leg slider member and the central support slider member for adding strength and stability to the extended configuration of the shelter framework. The tensioning means preferably includes a first cable 140 secured to each leg by a bracket 142 on the leg slider, a second cable 144 secured to a bracket 146 on the center slider, and a cable lock 148, such as an over center type of cable lock, for example, securing the first and second cables together. The central support member may also include a peak pole member 150, for further extending the top center of the canopy above the shelter framework, to draw the canopy tight.

Figure 7:
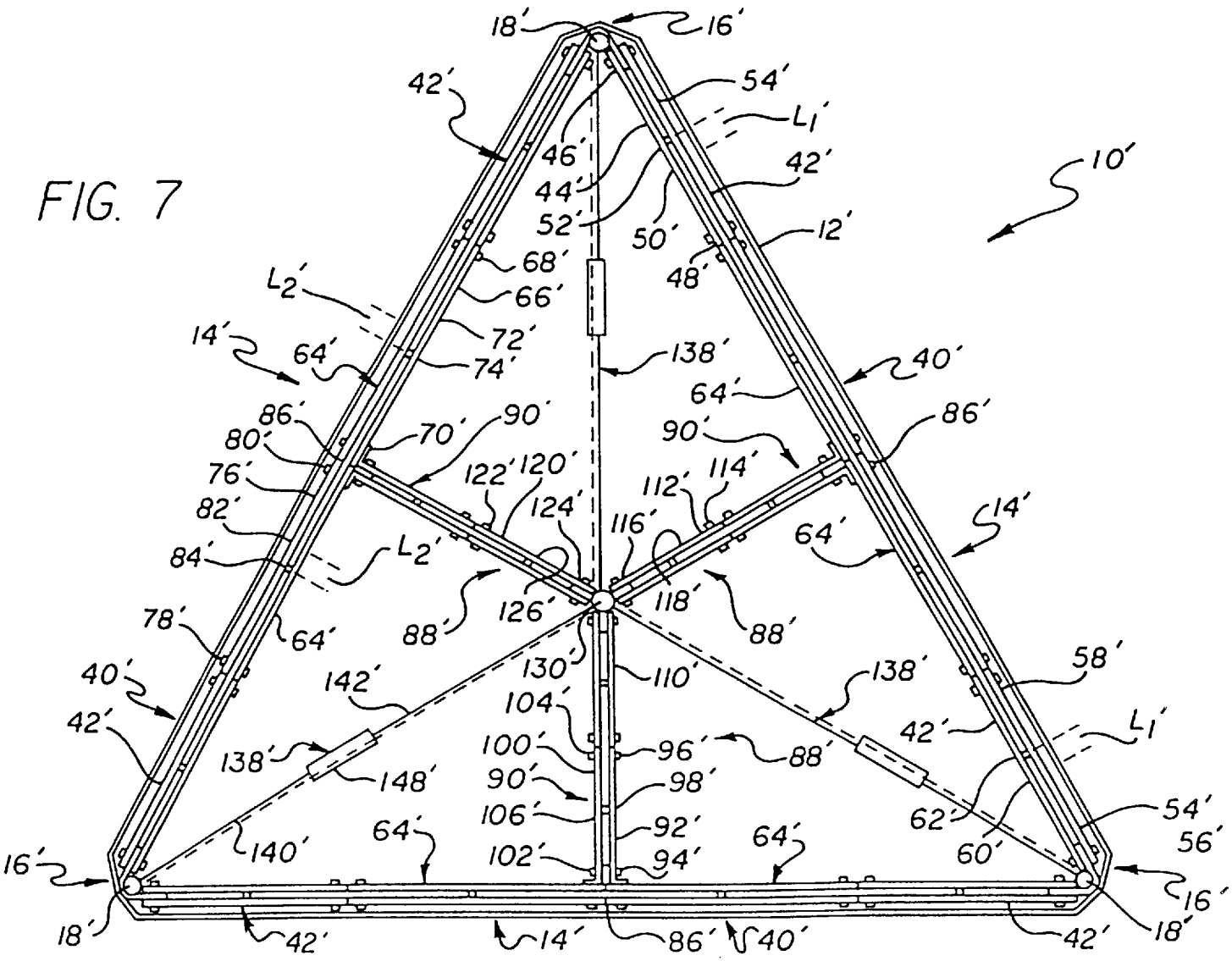
FIG. 7 is a top sectional view of a three-sided embodiment of the collapsible shelter of the invention, similar to that shown in FIG. 3.

One preferred three-sided embodiment of the collapsible shelter 10' of the invention is illustrated in FIG. 7, in which like reference numerals refer to like elements from the previous figures. The three-sided collapsible shelter is substantially similar to the four-sided embodiment illustrated in the previous figures, described above. The three-sided shelter includes a canopy 12' with three sides 14', and three corners 16'. Each leg 18' also preferably includes telescoping upper and lower sections for adjusting the leg height as desired, as described previously. A leg slider member is also slidably mounted on the upper section of each of the legs, as described above.

Referring to FIG. 7, the perimeter framework 38' includes perimeter truss means 40' including two first perimeter truss pairs 42' of link members connected to each of the legs at approximately 60 degree angles, with each of the first perimeter truss pairs including a first link member 44' having an outer end 46' connected to the upper end of a leg, an inner end 48', a longitudinal center 50', and a pivot point 52' spaced apart from the longitudinal center toward the outer end by a predetermined distance $L_1'$. Each of the first perimeter truss pairs further includes a second link 54' having an outer end 56' pivotally connected to the leg slider member, thus slidably connecting the second link to the upper section of the leg. The second link of the first perimeter truss pairs includes an inner end 58', a longitudinal center 60', and a pivot point 62' spaced apart from the longitudinal center toward the inner end by the same predetermined distance $L_1'$. The pivot points of the first and second links in each of the first perimeter truss pairs are pivotally connected in a modified scissors configuration, so that although the first and second link members extend a short distance generally horizontally toward another leg in a first collapsed position of the shelter, as previously shown in FIG. 6, the first and second link members extend to a second extended position with the inner ends of the link members extending above the upper end of the leg, as was previously shown in FIG. 2.

In the three-sided collapsible shelter embodiment, the perimeter truss means also includes a second perimeter truss pair 64' of link members, which is pivotally connected to each of the first perimeter truss pairs, to extend the framework further above the legs of the shelter. Each of the second perimeter truss pairs preferably includes a first link 66' having an outer end 68' pivotally connected to the inner end of the second link of the associated first perimeter truss pair, an inner end 70', a longitudinal center point 72', and a pivot point 74' spaced apart from the longitudinal center point toward the inner end a predetermined distance $L_2'$. Each of the second perimeter truss pairs also preferably includes a second link 76' having an outer end 78' pivotally connected to the inner end of the first link of the associated first perimeter truss pair, an inner end 80', a longitudinal center point 82', and a pivot point 84' spaced apart from the longitudinal center point toward the outer end the predetermined distance $L_2'$. The pivot points of the first and second links in each of the second perimeter truss pairs are preferably pivotally connected together, resulting in a modified scissors configuration so that the second truss pairs are also extendable from a first collapsed position extending generally horizontally between legs, to a second extended position extending above the first perimeter truss pair. The inner ends of each second perimeter truss pair are further preferably pivotally connected to the inner ends of another second perimeter truss pair at a junction 86' centered between two legs of one side of the shelter framework.

With further reference to FIG. 7, three central truss means 88' are also provided, including at least two outer central truss pairs 90' of link members, with each of the outer central truss pairs being pivotally connected to the inner ends of at least one of the second perimeter truss pairs at the junction 86', such as by right angle bracket members 87', to which the inner ends of the second perimeter truss pairs and the outer central truss pairs are pivotally connected. Each of the outer central truss pairs preferably includes a first link 92' having an outer end 94' connected to the inner end of the second link of the second perimeter truss pair, an inner end 96', and a pivot point 98' located at the longitudinal center point of the outer central truss pair first link. Each of the outer central truss pairs also preferably includes a second link 100' having an outer end 102' connected to the inner end of the first link of the second perimeter truss pair, an inner end 104', and a pivot point 106' located at the longitudinal center point of the outer central truss pair second link. Each of the pivot points of the first and second links of the outer central truss pairs are pivotally connected together to extend horizontally between the sides of the shelter framework.

In the three-sided collapsible shelter embodiment, each central truss means also includes an inner central truss pair 110' of link members, with each of the inner central truss pairs being pivotally connected to the inner ends of an associated outer center truss pair. Each of the inner central truss pairs preferably includes a first link 112' having an outer end 114' connected to the inner end of the second link of the outer central truss pair, an inner end 116', and a pivot point 118' located at the longitudinal center point of the inner central truss pair first link. Each of the inner central truss pairs also preferably includes a second link 120' having an outer end 122' connected to the inner end of the first link of the outer central truss pair, an inner end 124', and a pivot point 126' located at the longitudinal center point of the inner central truss pair second link. Each of the pivot points of the first and second links of the inner central truss pairs are pivotally connected together to extend horizontally between the sides of the shelter framework. The inner ends of each of the first and second links of the inner central truss pairs are preferably pivotally connected to the inner ends of the first and second links of at least one other of the inner central truss pairs. The inner ends of the inner central truss pairs are preferably connected to at least one vertically oriented central support member 130' provided to support the canopy when the shelter framework is in an extended configuration. As described above, a central slider member is also preferably pivotally connected to an inner end of the inner central truss pair, and is disposed to slidably engage the central support member when the shelter framework is in an extended configuration. The inner ends of each of the first links of the inner central truss pairs are preferably pivotally connected to one of the central support member and the central slider member, and the inner ends of each of the second links of the inner central truss pairs are preferably pivotally connected to the other of the central support member and the central slider member.

A tensioning means 138' is also preferably connected between the leg slider member and the central support slider member in the three-sided collapsible shelter embodiment. The tensioning means preferably includes a first cable 140' secured to each leg, a second cable 144' secured to the center slider, and a cable lock 148', such as an over center type of cable lock, for example, securing the first and second cables together. The central support member may also include a peak pole member (not shown) for further extending the top center of the canopy above the shelter framework, to draw the canopy tight.

Figure 8:
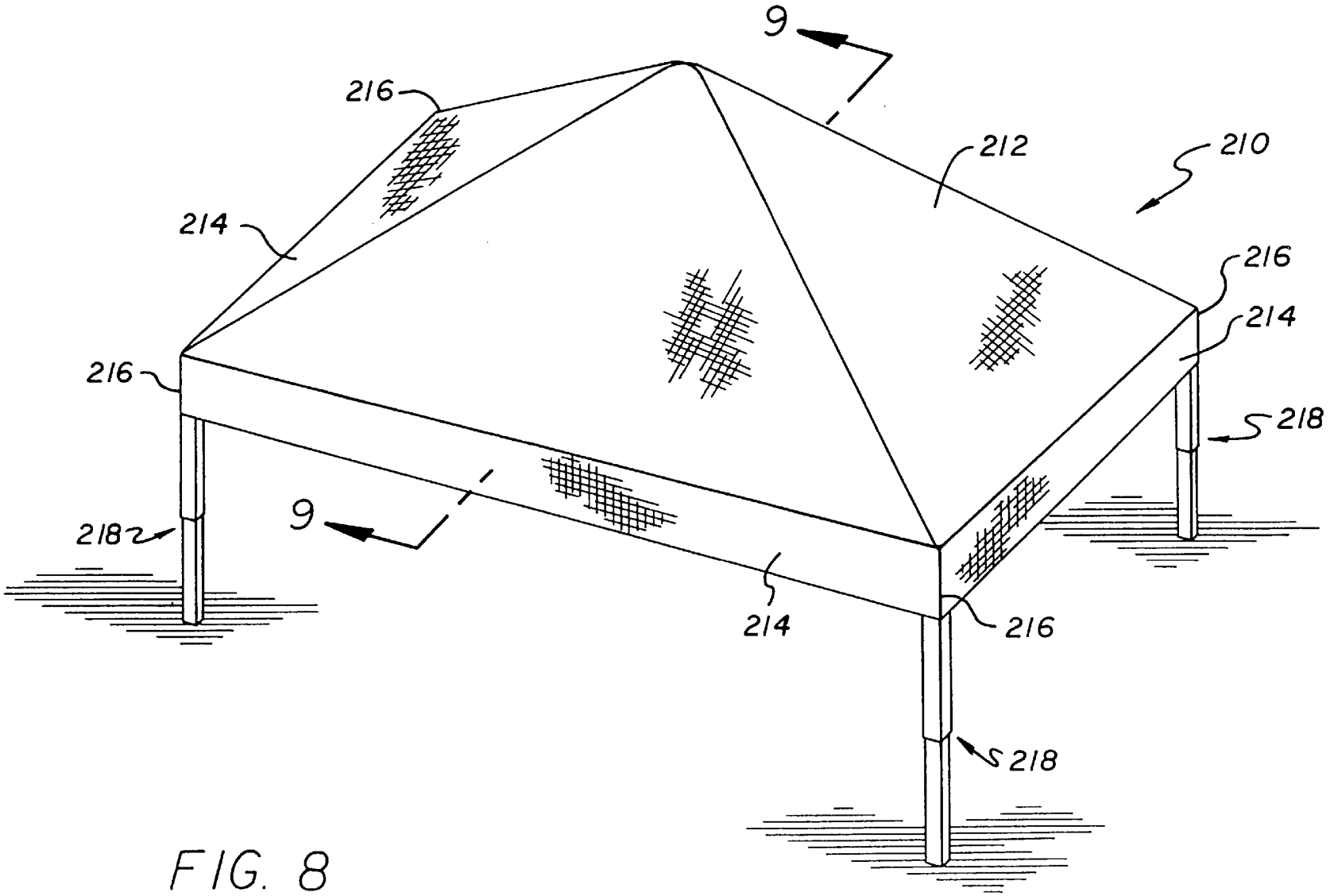
FIG. 8 is a perspective view of an alternate high peaked embodiment of the collapsible shelter of the invention, showing the elevated gabled roof structure.

In a third alternate preferred embodiment shown in FIG. 8, the invention is embodied in a collapsible shelter 210, having a canopy 212 with at least three sides 214, and preferably four sides, at least three corners 216, and preferably four corners. The canopy is preferably formed of nylon fabric, so as to be light and easily transportable, although the canopy could also be made of other suitable sheet materials, such as canvass, or other types of cloth fabric, or plastic. At least three, and preferably four, legs 218 support the canopy, with a leg disposed under each corner of the canopy. Particularly referring to FIG. 9, each of the legs has an upper end 220 and a lower end 222, and preferably each leg includes telescoping upper and lower sections 224 and 226, respectively, with the telescoping lower section including a spring loaded detent pin 227 for indexing in apertures 228 provided in the upper section for adjusting the leg height as desired. The extendable lower section also preferably includes a foot portion 229 for engagement with the ground or other floor surface.

Figure 9:
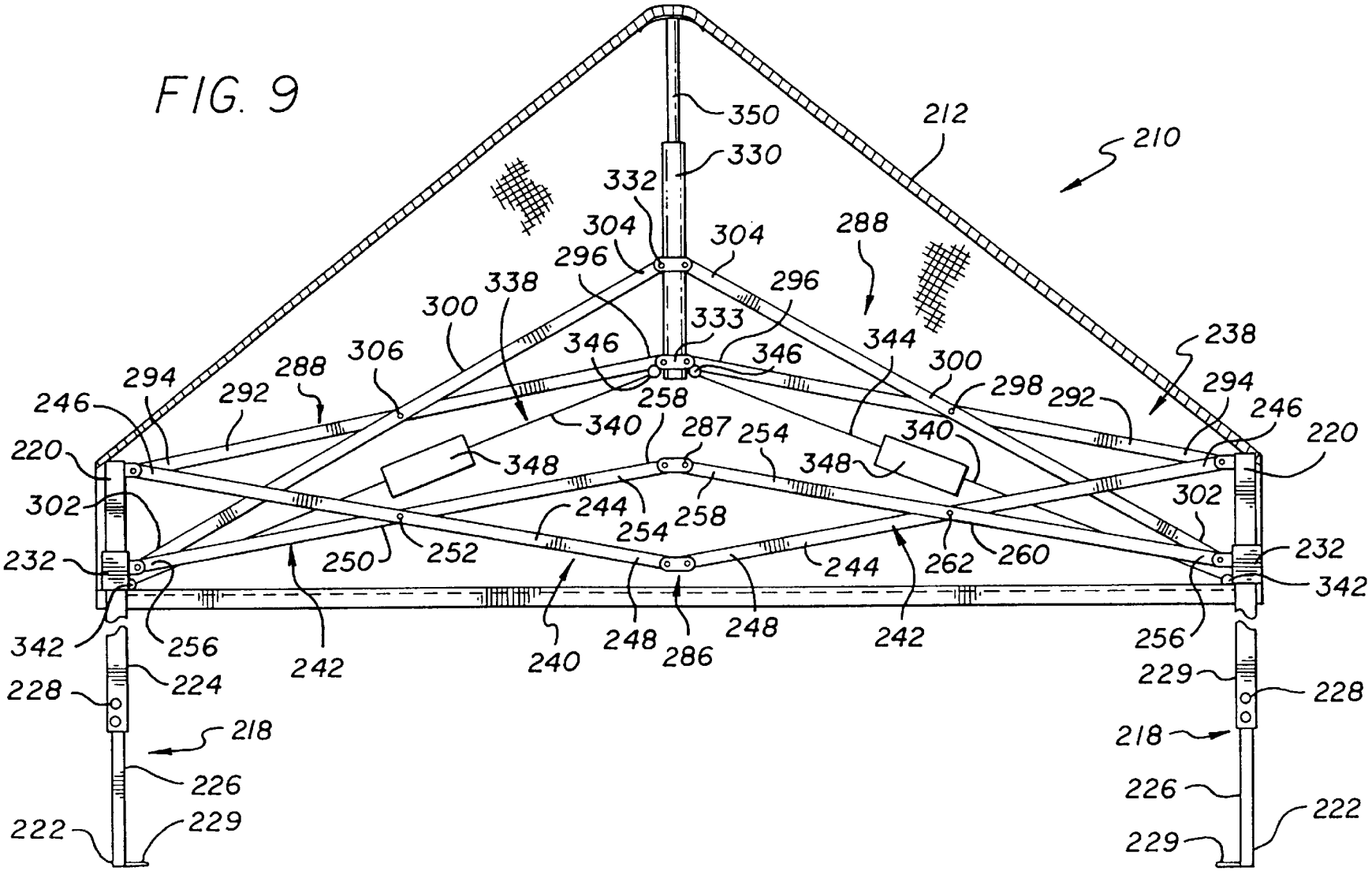
FIG. 9 is a cross-sectional elevational view of the embodiment of FIG. 8, showing the perimeter and central truss pairs of the shelter in an extended, raised configuration.

With reference to FIGS. 5 and 9, a leg slider member 232 is also slidably mounted on the upper section of each of the legs. A spring loaded detent pin is also provided in the upper leg section for indexing with an aperture in the leg slider member.

Figure 11:
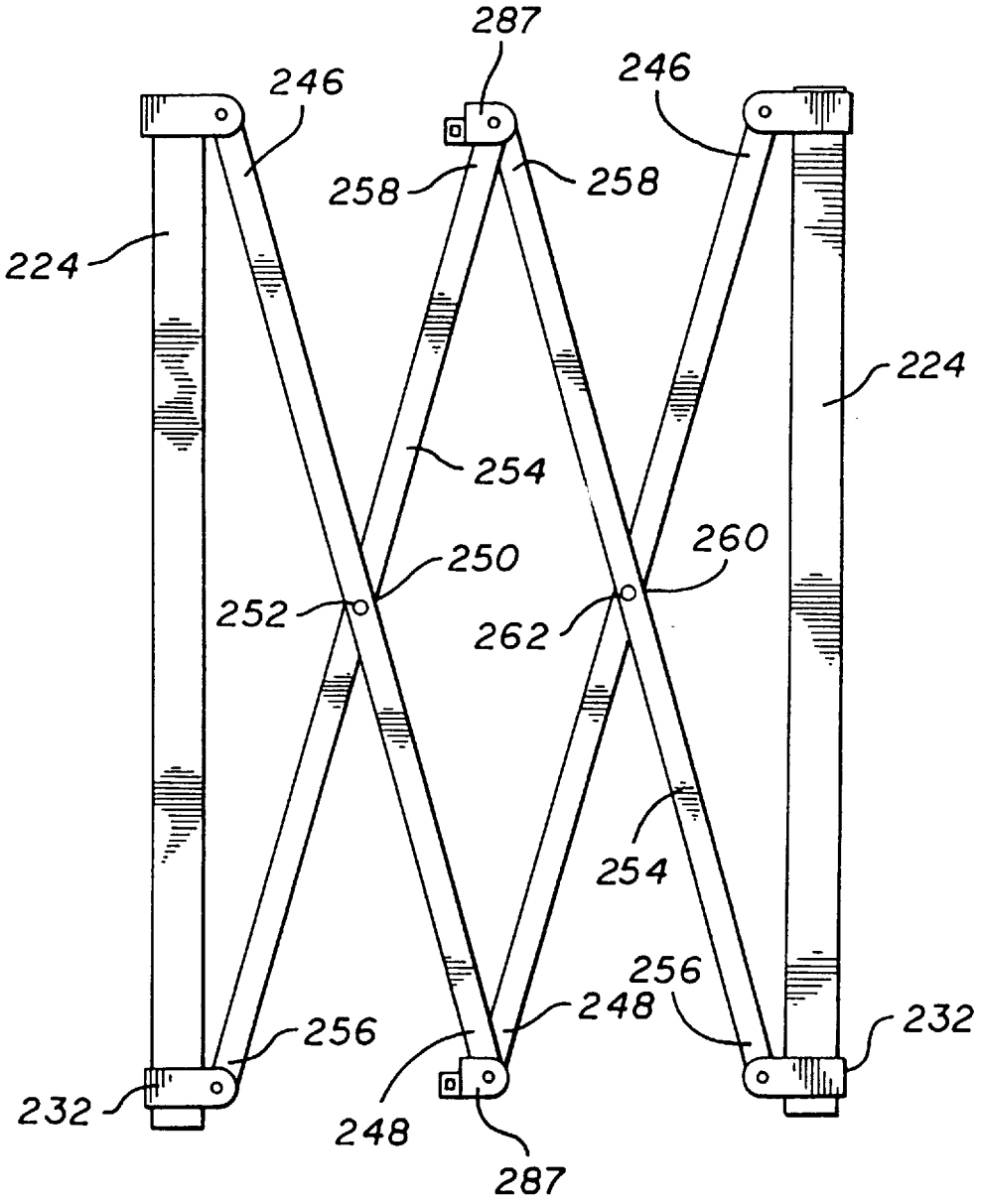
FIG. 11 is a side elevational view of the framework of the collapsible shelter of FIG. 8, showing the perimeter truss pairs in a substantially collapsed configuration.

Referring to FIGS. 9 and 11, in the third alternate embodiment, the perimeter framework 238 includes perimeter truss means 240 including two perimeter truss pairs 242 of link members connected to each of the legs at right angles, with each of the perimeter truss pairs including a first link member 244 having an outer end 246 connected to the upper end of a leg, an inner end 248, a longitudinal center 250, and a centrally located pivot point 252 pivotally connected to a second link 254 having an outer end 256 pivotally connected to the leg slider member, thus slidably connecting the second link to the upper section of the leg. The second link of the perimeter truss pairs includes an inner end 258, a longitudinal center 260, and a centrally located pivot point 262. The first and second links in each of the perimeter truss pairs are pivotally connected at their pivot points in a standard scissors configuration.

The inner ends 248, 258 of each perimeter truss pair are further preferably pivotally connected to the inner ends 248, 258 of another perimeter truss pair at a junction 286 centered between two legs of one side of the shelter framework.

Figure 10:
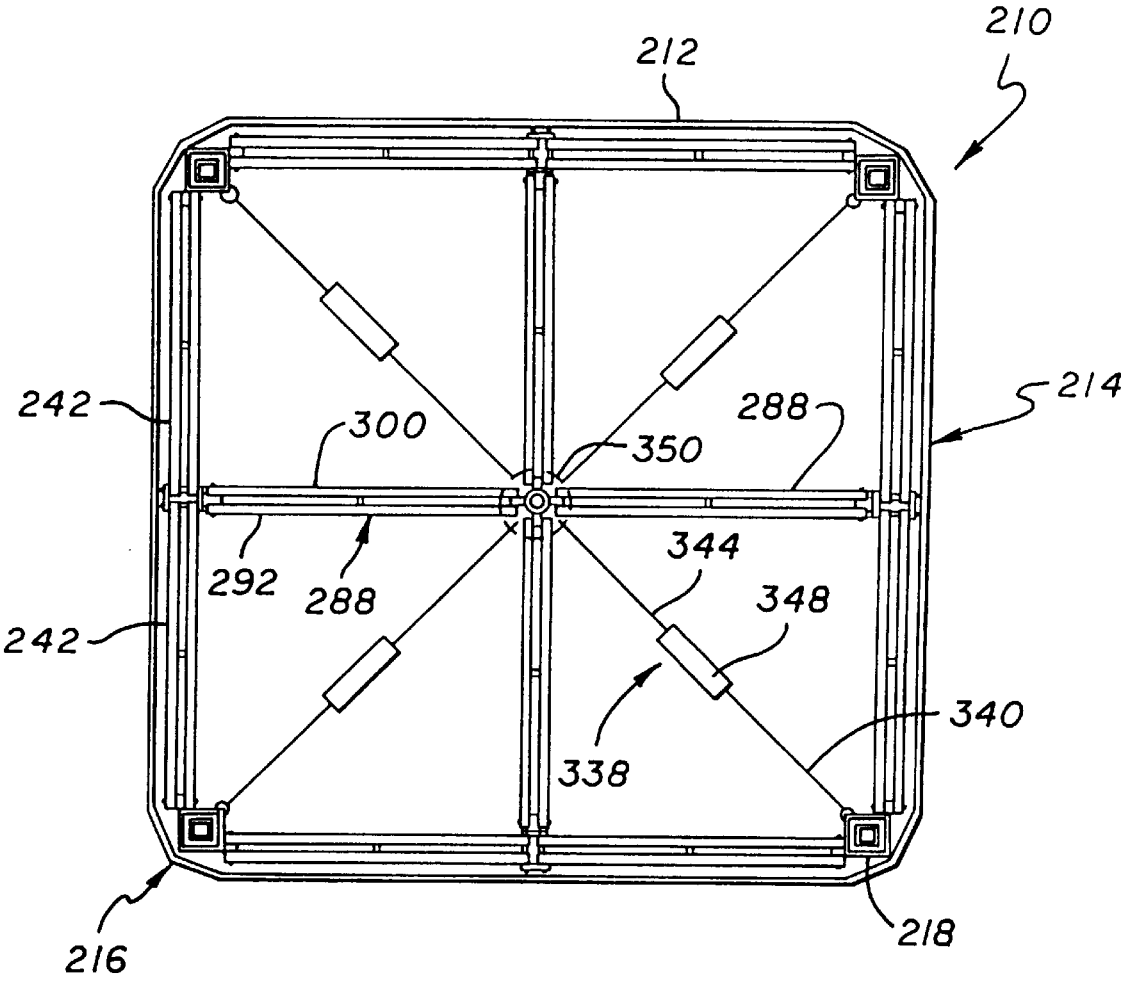
FIG. 10 is a top sectional view of the collapsible shelter of FIG. 8.

As is best seen in FIGS. 9 and 10, a plurality of central truss pairs 288 of link members are also provided, with each of the central truss pairs being pivotally connected to the inner ends of the perimeter truss pairs at the junction 286, such as by right angle bracket members 287, to which the inner ends of the perimeter truss pairs and the central truss pairs are pivotally connected. In this third embodiment, the framework of the shelter has a square configuration, and four central truss pairs are provided, connected to the four side junctions of the shelter framework. Where the shelter framework has three sides, three central truss pairs may be provided, as will be further explained below. Each of the central truss pairs preferably includes a first link 292 having an outer end 294 connected to an inner end of at least one of the first links of a perimeter truss pair on a side, an inner end 296, and a pivot point 298 located at the longitudinal center point of the central truss pair first link. Each of the central truss pairs also preferably includes a second link 300 having an outer end 302 connected to an inner end of at least one of the second links of the perimeter truss pairs on a side, an inner end 304, and a pivot point 306 located at the longitudinal center point of the central truss pair second link. The second links of the central truss pairs are preferably longer than the first links of the central truss pairs, so that in an expanded configuration of the shelter, the second link extends well above the top of the legs, to give the shelter a high peaked canopy. For example, for a first link of approximately 10 feet six inches in length, the second link can be approximately 12 feet long, with the top, inner end of the second link reaching approximately 4 feet above the top of the legs and the junction of the perimeter truss pairs.

The inner ends of the first or second links of the central truss pairs are further preferably connected to at least one vertically oriented central support member 330, provided to support the canopy and give the canopy a high pitch, high peaked shape when the shelter framework is in an extended configuration. In a preferred embodiment, the central truss pairs are pivotally connected to the central support member by a bracket 332. A central slider member 333 is pivotally connected to the inner ends of the other of the first or second links of the central truss pair, and is disposed to slidably engage and stabilize the central support member when the shelter framework is in an extended configuration.

One presently preferred aspect of this embodiment, may be a tensioning means 338 connected between the leg slider member and the central support slider member for adding strength and stability to the extended configuration of the shelter framework. The tensioning means preferably includes a first cable 340 secured to each leg by a bracket 342 on the leg slider, a second cable 344 secured to a bracket 346 on the center slider, and a cable lock 348, such as an over center type of cable lock, for example, securing the first and second cables together. The central support member may also include a peak pole member 350, for further extending the top center of the canopy above the shelter framework, to draw the canopy tight.

Figure 12:
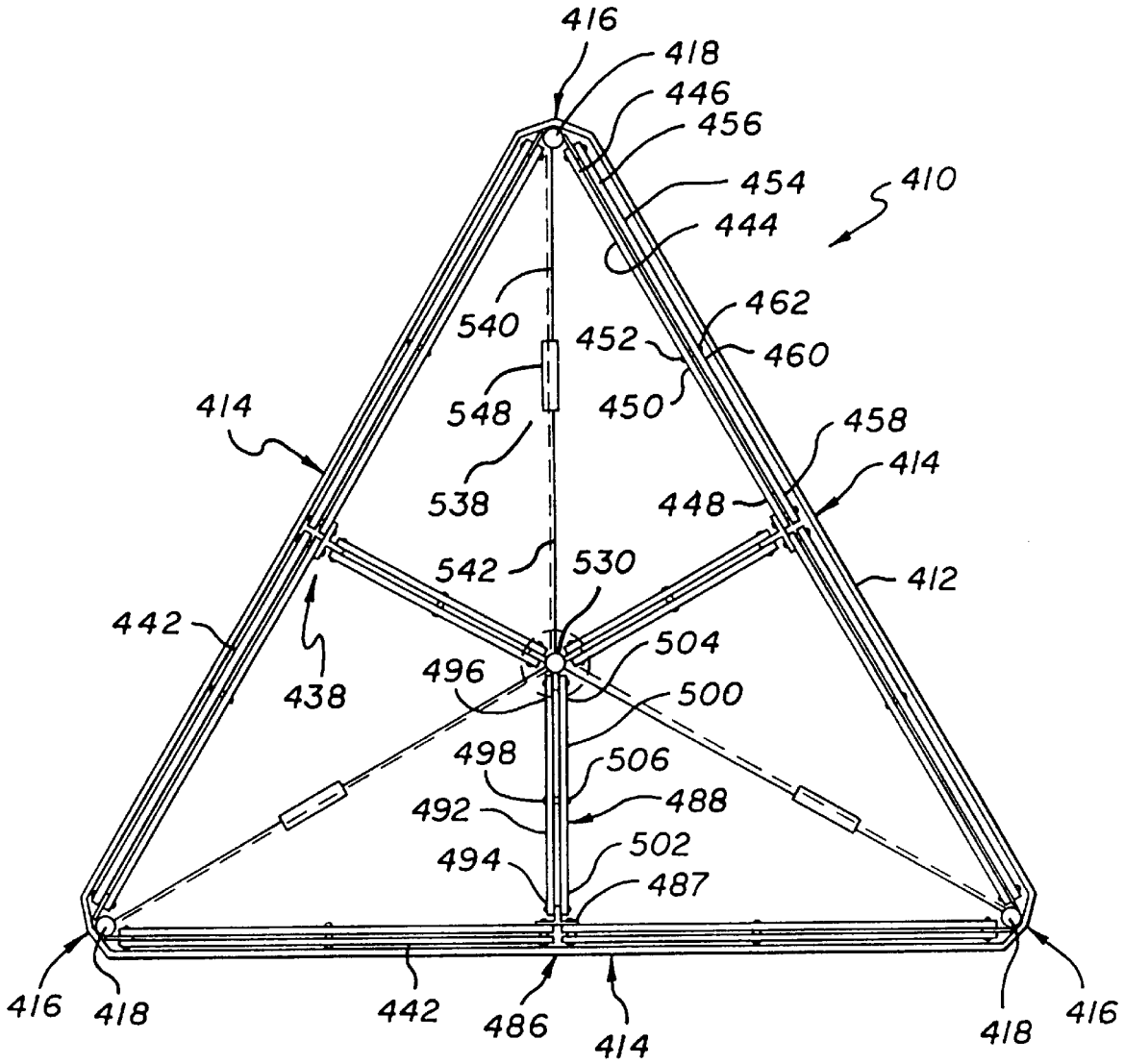
FIG. 12 is a top sectional view of a three-sided embodiment of the collapsible shelter of FIG. 8.
Figure 13:
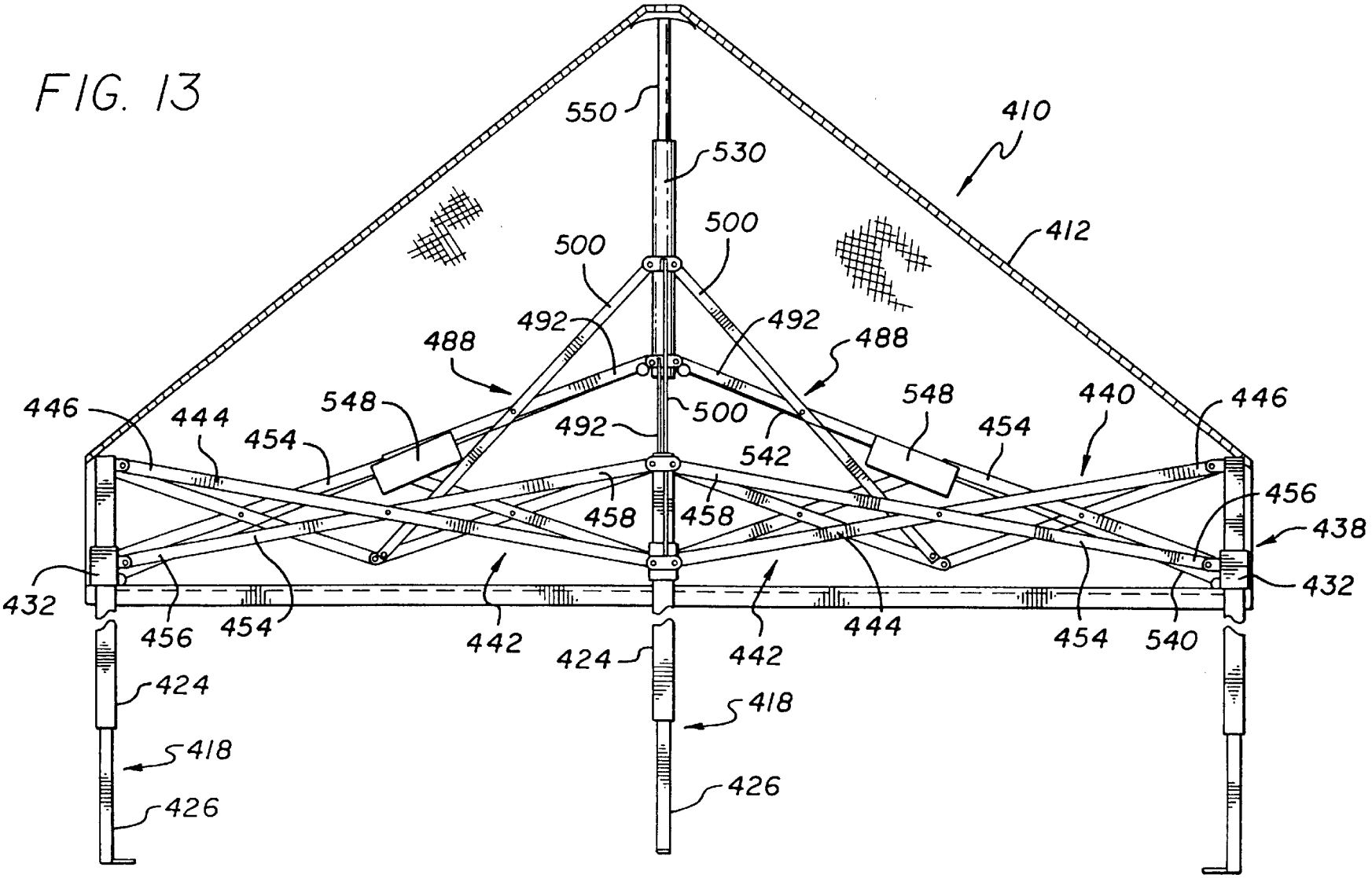
FIG. 13 is a cross-sectional elevational view of the three sided alternate embodiment of the collapsible shelter of the invention, similar to FIG. 9, showing the perimeter and central truss pairs of the shelter in an extended, raised configuration.

A preferred three-sided embodiment of the collapsible shelter 410 of the invention substantially similar to the four-sided embodiment illustrated in FIGS. 8–11 is illustrated in FIGS. 12 and 13, in which like reference numerals refer to like elements from FIGS. 8–11. The three-sided shelter includes a canopy 412 with three sides 414, and three corners 416. Each leg 418 also preferably includes telescoping upper 424 and lower 426 sections for adjusting the leg height as desired, as described previously. A leg slider member 432 is also slidably mounted on the upper section of each of the legs, as described above.

Referring to FIGS. 12 and 13, the perimeter framework 438 includes perimeter truss means 440 including two perimeter truss pairs 442 of link members connected to each of the legs at approximately 60 degree angles, with each of the first perimeter truss pairs including a first link member 444 having an outer end 446 connected to the upper end of a leg, an inner end 448, a longitudinal center 450, and a centrally located pivot point 452 pivotally connected to a second link 454 having an outer end 456 pivotally connected to the leg slider member, slidably connecting the second link to the upper section of the leg. The second link of the perimeter truss pairs includes an inner end 458, a longitudinal center 460, and a centrally located pivot point 462. The pivot points of the first and second links in each of the perimeter truss pairs are pivotally connected in a normal scissors configuration. The inner ends of each perimeter truss pair are preferably pivotally connected to the inner ends of another perimeter truss pair at a junction 486 centered between two legs of one side of the shelter framework.

With further reference to FIGS. 12 and 13, three central truss pairs 488 of link members are also provided, with each of the truss pairs being pivotally connected to the inner ends of at least one of the perimeter truss pairs at the junction 486, such as by right angle bracket members 487, to which the inner ends of the perimeter truss pairs and the central truss pairs are pivotally connected. Each of the central truss pairs of link members preferably includes a first link 492 having an outer end 494 connected to the inner end of at least one of the first links of the perimeter truss pairs on a side, an inner end 496, and a pivot point 498 located at the longitudinal center point of the central truss pair first link. Each of the central truss pairs also preferably includes a second link 500 having an outer end 502 connected to the inner end of at least one of the second links of the perimeter truss pairs on a side, an inner end 504, and a pivot point 506 located at the longitudinal center point of the central truss pair second link. The second links of the central truss pairs are preferably longer than the first links of the central truss pairs, so that in an expanded configuration of the shelter, the second link extends well above the top of the legs, to give the shelter a high peaked canopy. For example, for a first link of approximately 10 feet six inches in length, the second link can be approximately 12 feet long, with the top, inner end of the second link reaching approximately 4 feet above the top of the legs and the junction of the perimeter truss pairs.

The inner ends of the first or second links of the central truss pairs are further preferably connected to at least one vertically oriented central support member 530, provided to support the canopy and give the canopy a high pitch, high peaked shape when the shelter framework is in an extended configuration, as described above for the embodiment of FIGS. 8–11. A central slider member is pivotally connected to the inner ends of the other of the first or second links of the central truss pair, and is disposed to slidably engage and stabilize the central support member when the shelter framework is in an extended configuration.

A tensioning means 538 is also preferably connected between the leg slider member and the central support slider member in the three-sided collapsible shelter embodiment. The tensioning means preferably includes a first cable 540 secured to each leg, a second cable 544 secured to the center slider, and a cable lock 548, such as an over center type of cable lock, for example, securing the first and second cables together. As described earlier, the central support member may also include a peak pole member 550 for further extending the top center of the canopy above the shelter framework, to draw the canopy tight.

In light of the above description, it will be apparent that the invention provides for a quickly erectable, collapsible shelter having an elevated roof, that is raised to provide more headroom, and can be gabled or provide a high, sloped peaked roof to shed precipitation and debris, and to provide greater strength and stability of the shelter when the framework is in an extended configuration.

It will be apparent from the foregoing that while particular forms of the invention have been illustrated and described, various modifications can be made without departing from the spirit and scope of the invention. Accordingly, it is not intended that the invention be limited, except as by the appended claims.

What is claimed is:

1. A collapsible shelter, comprising:

a canopy;

a leg assembly supporting said canopy;

a plurality of central truss pairs of link members of unequal length connected together in a scissors configuration so as to be extendable from a first collapsed position not extending above said leg assembly to a second extended position extending above said leg assembly; and a perimeter truss linkage assembly connected to said leg assembly, and connecting said plurality of central truss pairs of link members to said leg assembly.

2. The collapsible shelter of claim 1, further comprising a vertically oriented central support member for supporting said canopy, and a central support slider member disposed to slidably engage said central support member, the inner ends of said central truss pairs being pivotally connected to said central support member and said central support slider member.

3. The collapsible shelter of claim 2, further comprising a leg slider member slidably mounted to said leg assembly, said perimeter truss linkage assembly being pivotally connected to said leg slider members, and further comprising a tensioning cable connected between said leg slider member and said central support slider member.

4. The collapsible shelter of claim 1, further comprising a leg slider member slidably mounted to said leg assembly, and wherein said perimeter truss linkage assembly is pivotally connected to said leg slider members.

5. A collapsible shelter, comprising:

a canopy;

a leg assembly;

a plurality of central truss pairs of link members of unequal length connected together in a scissors configuration so as to be extendable from a first collapsed position not extending above said leg assembly to a second extended position extending above said leg assembly;

a perimeter truss linkage assembly connected to said leg assembly, and connecting said plurality of central truss pairs of link members to said leg assembly;

a vertically oriented central support member for supporting said canopy; and a central support slider member disposed to slidably engage said central support member, the inner ends of said central truss pairs being pivotally connected to said central support member and said central support slider member.

6. The collapsible shelter of claim 5, further comprising a plurality of leg slider members, each of said leg slider members being slidably mounted to a leg of said leg assembly.

7. The collapsible shelter of claim 6, further comprising a plurality of tensioning cables connected between said plurality of leg slider members and said central support slider member.

* * * * *

UNITED STATES PATENT AND TRADEMARK OFFICE

CERTIFICATE OF CORRECTION

PATENT NO. : 5,813,425

DATED : Sep. 29, 1998

INVENTOR(S) : Mark C. Carter

It is certified that error appears in the above-identified patent and that said Letters Patent is hereby corrected as shown below:

On the title page: Item [56]

"References Cited", under "U.S. PATENT DOCUMENTS", add the following patents before "5,634,483 6/1997 Gwin":

--1,712,836 9/1929 A. Mills
1,853,367 8/1932 Mace
4,407,317 6/1983 Crandall
4,601,301 7/1986 Hermanson
4,607,656 8/1986 Carter
4,641,676 2/1987 Lynch
4,947,884 8/1990 Lynch
5,035,253 7/1991 Bortles
5,244,001 9/1993 Lynch
5,275,188 1/1994 Tsai--.

Front page, "References Cited", add new title --FOREIGN PATENT DOCUMENTS-- after above listed patents.

Front page, "References Cited", after new title "FOREIGN PATENT DOCUMENTS", add the following patents:

--7755 3/1915 Great Britain
AU B 2564988 6/1992 Australia--.

Signed and Sealed this

Fifth Day of January, 1999

*Attest:*

*Attesting Officer*

*Acting Commissioner of Patents and Trademarks*